US009642417B2

(12) United States Patent
Eldem

(10) Patent No.: US 9,642,417 B2
(45) Date of Patent: May 9, 2017

(54) LACE-TYING SYSTEM

(71) Applicant: Nike, Inc., Beaverton, OR (US)

(72) Inventor: Can Eldem, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 420 days.

(21) Appl. No.: 13/678,751

(22) Filed: Nov. 16, 2012

(65) Prior Publication Data

US 2014/0137432 A1 May 22, 2014

(51) Int. Cl.

| | |
|---|---|
| ***A43C 1/00*** | (2006.01) |
| ***A43B 1/00*** | (2006.01) |
| ***A43C 7/00*** | (2006.01) |
| ***A43C 7/08*** | (2006.01) |
| ***A43C 11/14*** | (2006.01) |

(52) U.S. Cl.

CPC ..... *A43C 1/00* (2013.01); *A43B 1/0081* (2013.01); *A43C 7/00* (2013.01); *A43C 7/08* (2013.01); *A43C 11/1493* (2013.01); *Y10T 24/3726* (2015.01)

(58) Field of Classification Search

CPC ..... A43C 7/00; A43C 7/08; A43C 11/1493; Y10T 24/3703; Y10T 24/3705; Y10T 24/3713

USPC ..... 24/712.1–712.6, 713; 36/136; 2/245, 2/246

See application file for complete search history.

(56) References Cited

U.S. PATENT DOCUMENTS

| | | | | |
|---|---|---|---|---|
| 3,103,725 A | | 9/1963 | Robb et al. | |
| 4,112,551 A | * | 9/1978 | Sales | A45C 13/1046 24/136 B |
| 4,393,550 A | | 7/1983 | Yang et al. | |
| 4,428,101 A | | 1/1984 | Harkavy | |
| 4,553,293 A | * | 11/1985 | Blum | 24/712.2 |
| 4,790,048 A | * | 12/1988 | Arnt | 24/712.1 |
| 4,884,321 A | | 12/1989 | Holub | |
| 5,097,573 A | * | 3/1992 | Gimeno | 24/712.6 |
| 5,293,675 A | | 3/1994 | Shai | |
| 5,335,400 A | | 8/1994 | Sales | |
| 5,493,731 A | * | 2/1996 | Amnott | 2/148 |

(Continued)

FOREIGN PATENT DOCUMENTS

| | | |
|---|---|---|
| GB | 1 457 313 A | 12/1976 |
| WO | 98/47401 A1 | 10/1998 |

(Continued)

OTHER PUBLICATIONS

International Search Report and Written Opinion mailed Mar. 12, 2014 in PCT/US2013/069967.

*Primary Examiner* — Richale Quinn

*Assistant Examiner* — Anne Kozak

(74) *Attorney, Agent, or Firm* — Honigman Miller Schwartz and Cohn LLP; Matthew H. Szalach; Jonathan P. O'Brien

(57) ABSTRACT

A lace-tying system with two components through which both sides of a lace are laced is disclosed. The first component can slide down the lace to tighten the article of footwear or up the lace to loosen the article of footwear. After the first component is pushed down to the article of footwear top to tighten the article of footwear, the second component is attached to the first component using a fastener, thus forming a double bow with the portions of the lace between the first component and the second component.

20 Claims, 11 Drawing Sheets

(56) References Cited

U.S. PATENT DOCUMENTS

| | | | | |
|---|---|---|---|---|
| 5,953,800 | A * | 9/1999 | Duckett | 24/712.1 |
| 6,334,240 | B1 * | 1/2002 | Li | 24/115 G |
| 6,453,525 | B1 | 9/2002 | Liu | |
| 6,571,437 | B2 | 6/2003 | Liu | |
| 7,124,482 | B2 * | 10/2006 | Kim | 24/712.1 |
| 7,152,285 | B2 | 12/2006 | Liao | |
| 7,574,786 | B2 * | 8/2009 | Cheng | 24/712.5 |
| 7,650,706 | B2 * | 1/2010 | Wartel et al. | 36/54 |
| D667,749 | S * | 9/2012 | Case et al. | D11/3 |
| D676,734 | S * | 2/2013 | Moreau et al. | D8/356 |
| 8,677,578 | B2 * | 3/2014 | Singh | 24/712.5 |
| 2005/0167986 | A1 * | 8/2005 | Burns et al. | 289/1.2 |
| 2013/0125356 | A1 * | 5/2013 | Chen | 24/713 |

FOREIGN PATENT DOCUMENTS

| | | | |
|---|---|---|---|
| WO | 2004/095968 | A1 | 11/2004 |
| WO | 2008/041874 | A1 | 4/2008 |

* cited by examiner

LACE-TYING SYSTEM

BACKGROUND

The present embodiments relate to devices for tying laces, such as the laces of an article of footwear, that would allow a wearer to quickly and easily fasten his or her shoelaces.

Articles of footwear typically have at least two major components, an upper that provides the enclosure for receiving the foot, and a sole secured to the upper. In many articles, the upper is fastened around the foot using laces to secure the article properly to the foot. The laces are laced through the article eyelets, and then tied at the front upper surface of the article, typically leaving a double bow.

SUMMARY

This summary is intended to provide an overview of the tying system, and is not intended to identify its essential features or key elements, nor is it intended to be used to determine the scope of the claims. The proper scope of the claims may be ascertained from the detailed description of the embodiments provided below, the figures referenced therein and the language in the claims.

Embodiments of the tying system have two components made from a relatively soft and flexible material such as, for example, leather or fabric, that cooperate to enable a wearer to tie his or her laces quickly and easily. The lace is first laced through the eyelets of the article of footwear, leaving a length of lace on either side of the article of footwear. Then the two ends of the lace are laced through the tying system, as described below.

In one aspect, a lace-tying system includes a first component having a top side and a bottom side with at least one opening through which two sides of a lace may be laced from the bottom side of the first component. The first component also has a first fastener portion of a fastener on the top side of the first component. The lace-tying system includes a second component with at least one first opening at one end through which the two sides of the lace may be laced, and two additional openings that are spaced apart from the first opening and are spaced apart from each other. The second component also has a second fastener portion of the fastener on a bottom side of the second component. The first fastener portion and the second fastener portion of the fastener are complementary to each other such that the first component is configured to be removably attached to the second component. The first component and second component are configured such that when the lace-tying system is in use the two sides of the lace can be laced through the first component and then through the second component. The first component can be pushed down to tighten the lace on an article of footwear, and the second component can be attached to the first component by attaching the second fastener portion to the first fastener portion.

In another aspect, a lace-tying system includes a first component having a top side and a bottom side. The first component has a first fastener portion of a fastener disposed on the top side of the first component, and one or more openings on either side of the first fastener portion through which a first lace side and a second lace side can be slidably laced from the bottom side of the first component. The lace-tying system also includes a second component having a first opening that is sufficiently large to slidably accommodate both the first lace side and the second lace side and further has a second fastener portion of the fastener affixed to a bottom side of the second component. The second component has a first additional opening and a second additional opening, the first additional opening and the second additional opening being spaced apart from the first opening and from each other, where the first additional opening is dimensioned such that one of the first lace side and the second lace side can be laced through the first additional opening, and the second additional opening is dimensioned such that one of the second lace side and the first lace side can be laced through the second additional opening. The second fastener portion is complementary to the first fastener portion such that the second component can be removably attached to the first component by attaching the second fastener portion to the first fastener portion.

In another aspect, an article of footwear includes a lace laced through eyelets in the article of footwear, leaving a first side of the lace and a second side of the lace extending from the article of footwear, said first side of the lace and said second side of the lace being laced through a first component and a second component. The first component includes a first fastener portion of a fastener on a top side of the first component, and the second component includes a second fastener portion of the fastener on a bottom side of the second component such that the second component may be removably attached to the first component by attaching the second fastener portion to the first fastener portion. The first side of the lace and the second side of the lace are laced through the first component from beneath the first component, where the first side of the lace and the second side of the lace are then laced into the second component through a first opening at a distal end of the second component and out of the second component through a second opening and a third opening at a proximal end of the second component. The second opening and the third opening are spaced apart from each other and from the first opening, and wherein the first component and the second component are made from a relatively soft and flexible material.

In another aspect, an article of footwear includes a lace laced through eyelets in the article of footwear, leaving a first side of the lace and a second side of the lace extending from the article of footwear. A first component has a first fastener portion of a fastener affixed at the center of the top side of the first component, and at least one first opening on the first side of the first fastener portion and at least one second opening on the second side of the first fastener portion. A second component has a first opening at a distal end, and a second opening and a third opening spaced apart from each other and from the first opening. A second fastener portion of the fastener is affixed to the second component, where the first side of the lace is laced through the at least one first opening on the first side of the first fastener portion and the second side of the lace is laced through the at least one second opening on the second side of the first fastener portion. The first side of the lace is further laced through the first opening of the second component and out of one of the second opening and third opening of the second component, and the second side of the lace is laced through the first opening of the second component and out of the other one of the third opening and second opening of the second component. The first component can be pushed down to the top of the article of footwear to close the article of footwear around the wearer's foot and the second component can then be removably attached to the first component by attaching the second fastener portion to the first fastener portion, such that the first side of the lace and the second side of the lace each form a bow on either side of the article of footwear.

Other structures, objects, features and advantages of the embodiments will be apparent to one of ordinary skill in the art upon examination and study of the following detailed description and the accompanying figures. It is intended that all such additional structures, features and advantages be included within this description and this summary, be within the scope of the embodiments and be protected by the claims set forth below.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

For clarity, the detailed descriptions herein describe certain exemplary embodiments, but the disclosure herein may be applied to any tying system comprising certain of the features described herein and recited in the claims.

Figure 1:
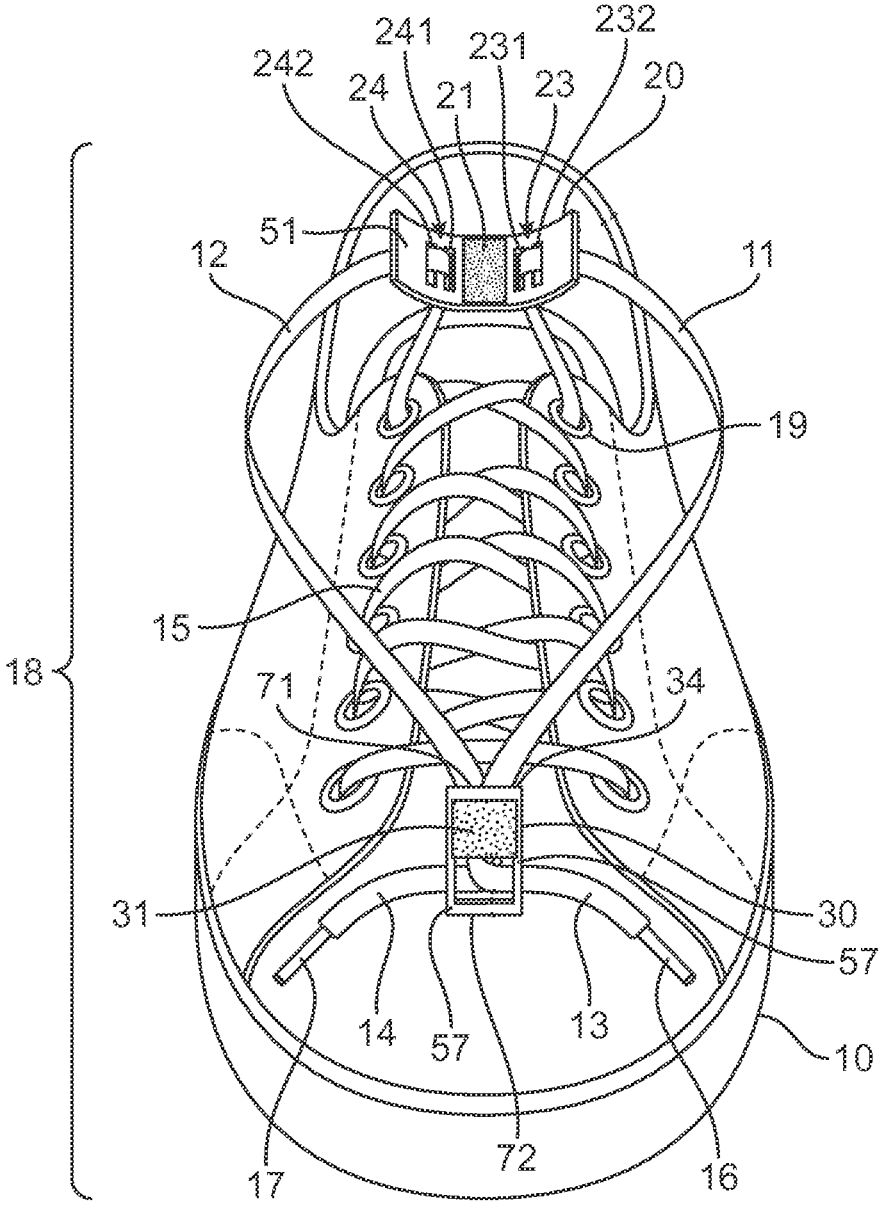
FIG. 1 is a front perspective view of an article of footwear with its lace laced through an embodiment of the lace-tying system, showing the lace-tying system in an initially deployed state.

FIG. 1 is a front perspective view of an article of footwear 10, herein also referred to simply as shoe 10. Shoe 10 may further be associated with an embodiment of a first component 20 and an embodiment of a second component 30, which collectively comprise a lace-tying system 18. Although the embodiments shown in the figures depict an article of footwear in the form of a generic athletic shoe, is should be understood that other embodiments of the lace-tying system could be used with other kinds of footwear incorporating a lace of some kind. Examples of other footwear that could be used with lace-tying system 18 include tennis shoes, running shoes, walking shoes, formal footwear, basketball shoes, baseball shoes, soccer shoes, boots, hiking boots, skating boots as well as any other kind of footwear incorporating a lace that requires tying.

The embodiment is shown in FIG. 1 in an initially deployed (or unfastened) state. In particular, shoe 10 comprises a lace 15, which is laced through the eyelets of the shoe 10. In some embodiments, first lace side 11 and second lace side 12 of lace 15 are laced through lace-tying system 18 in the manner described below in order to enable a wearer to quickly and easily fasten his or her shoelaces.

Figure 2:
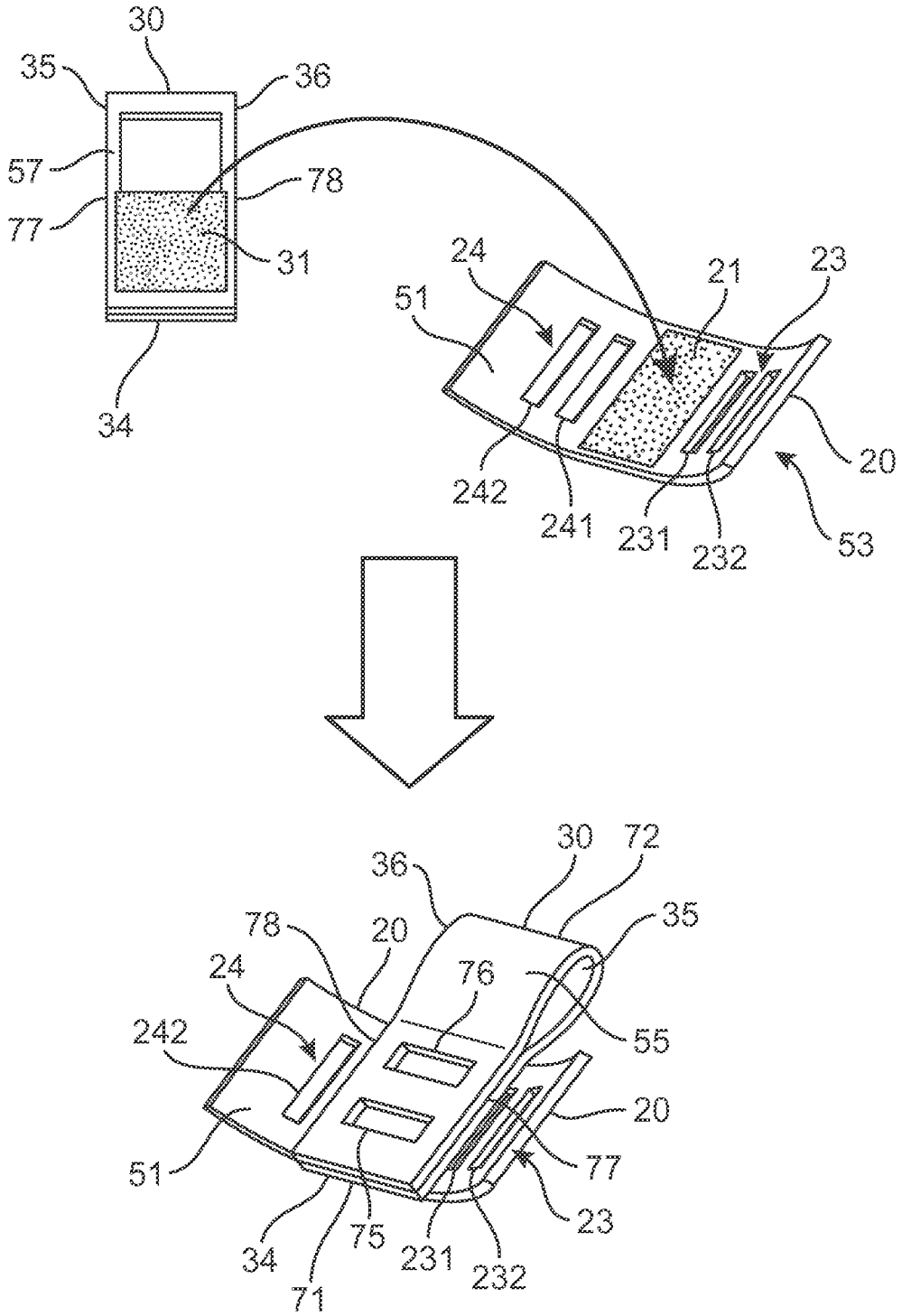
FIG. 2 shows the two components of the lace-tying system of FIG. 1.

For purposes of illustrating the components for lace-tying system 18, first component 20 and second component 30 are shown in isolation in FIG. 2. In addition, in the following discussion, reference is made to FIGS. 6 through 11, which illustrate enlarged isometric views of first component 20 and/or second component 30, including exemplary configurations of the association of lace 15 with first component 20 and second component 30.

Referring specifically now to FIG. 2, in some embodiments first component 20 and second component 30 of lace-tying system 18 may include provisions for lacing portions of lace 15 through first component 20, such that when first component 20 is pushed down to the top of shoe 10, first component 20 binds to lace 15 and cannot be easily dislodged. In some embodiments, each of first component 20 and second component 30 may be associated with lace receiving portions, including for example, lace receiving openings. In some embodiments, first component 20 and second component 30 each comprise one or more groups of openings for fastenably associating with a portion of lace 15.

In some embodiments, first component 20 may include first set of openings 23 and second set of openings 24, also referred to simply as openings 23 and openings 24, which are configured to receive opposing sides or ends of a lace. In some cases, first set of openings 23 further include slot 231 and slot 232, while second set of openings 24 further include slot 241 and 242. In different embodiments, the number, shape and/or arrangement of slots comprising openings 23 and openings 24 can be varied. In the example shown in FIG. 2, openings 23 and openings 24 each comprise two slots, but in other embodiments openings 23 and openings 24 may comprise any number of openings. Moreover, the shape of the slots comprising openings 23 and openings 24 may be any shape including, but not limited to: circular shapes, oval shapes, star shapes, hexagonal shapes, polygonal shapes, rectangular shapes or any other shapes. Still further, while the current embodiment illustrates slots that are approximately parallel, the relative orientation of two or more slots could be varied in other cases. The number, shape and arrangement of slots comprising each of openings 23 and openings 24 could vary according to factors including ease of use, lace type, desired tensioning as well as possibly other factors.

Second component 30 may also include openings for associating with sides and/or end portions of lace 15. In some embodiments, second component 30 may include first side opening 35 as well as second side opening 36 that are associated with a first side edge 77 and a second side edge 78, respectively, of second component 30. In addition, second component 30 may further include distal opening 34. For example, as seen in FIG. 2, as well as in FIGS. 9-11, first lace side 11 and second lace side 12 of lace 15 may be laced into second component 30 via distal opening 34 at distal end 71 of second component 30. As described here, distal end 71 may be an end of second component 30 that is disposed further from the ankle or heel when second component 30 is engaged with first component 20. In other words, distal end 71 may be disposed closer to a forward end of shoe 10.

In some cases, distal opening 34 may be large enough to slidably accommodate first lace side 11 and second lace side 12 of lace 15. After passing through distal opening 34, first lace side 11 and second lace side 12 of lace 15 may pass up through first intermediate opening 75 and back down through second intermediate opening 76. After passing through second intermediate opening 76, first lace side 11 and second lace side 12 of lace 15 may extend out through first side opening 35 and second side opening 36, respectively, at proximal end 72 (disposed opposite of distal end 71) of second component 30. In some cases, first side opening 35 and second side opening 36 may be spaced apart from distal opening 34, as well as from one another.

In the embodiment of lace-tying system 18 shown in FIG. 1, the distal opening 34 in second component 30 is an open end of second component 30. First side opening 35 and second side opening 36 are shown in FIGS. 1-5 at the proximal ends of the first side edge 77 and the second side edge 78, respectively, of second component 30. However, these openings could also be placed at the distal end of second component 30.

In different embodiments, one or more intermediate openings, as introduced above, may be optional. In some cases, inserting lace 15 through first intermediate opening 75 and second intermediate opening 76 may help hold second component 30 in place on lace 15. However, in other embodiments, second component 30 may not include first intermediate opening 75 and/or second intermediate opening 76. In embodiments without first intermediate opening 75 and second intermediate opening 76, first lace side 11 and second lace side 12 could be laced into distal opening 34 then out through first side opening 35 and second side opening 36, respectively, for example.

It will be understood that the particular number, shapes and arrangements of openings on second component 30 could be varied in other embodiments. For example, in some cases, second component 30 may comprise one, two, three, four or any other number of openings. Moreover, the shapes of each opening could vary in any manner, including, for example, any of the shapes described above for openings of first component 20. Still further, the spacing, orientation and/or general arrangement of openings on second component 30 could be varied in other embodiments.

In different embodiments, the geometry of first component 20 and/or second component 30 could vary. In some cases, first component 20 may have an approximately elongated shape. In some cases, first component 20 may further be symmetric in shape. However, in other embodiments, first component 20 could take on any other shapes including symmetric and asymmetric shapes. As seen for example in FIG. 9, in some embodiments second component 30 may be characterized as having a pouch-like shape, or a pouch-shaped portion. In the current embodiment, for example, second component 30 may bulge at proximal end 72. In some cases, this pouch-like configuration may create the necessary spacing for inserting portions of a lace through first side opening 35 and second side opening 36.

First component 20 and second component 30 may include provisions for releasably engaging one another in a manner that improves ease of use. In some embodiments, first component 20 and second component 30 may each be associated with complementary portions of a fastener. In some cases, for example, first component 20 may include a first fastener portion 21 (shown clearly in FIG. 2 as well as FIGS. 6-8) and second component 30 may include a second fastener portion 31 (shown in FIG. 2 as well as in FIGS. 11 and 13). In some cases, second fastener portion 31 may be a complementary portion to first fastener portion 21. In one embodiment, first fastener portion 21 and second fastener portion 31 are corresponding sides or portions of a hook-and-loop type fastener, such as a Velcro® fastener. However, in other embodiments other kinds of fasteners could be used including, but not limited to: snaps, straps, buttons, buckles, zippers, magnetic fasteners, other kinds of mechanical fasteners as well as any other kinds of fasteners that can be removably attached.

For understanding the arrangements of various portions of first component 20 and/or second component 30, the top and bottom portions of both components are described here. In some cases, first component 20 includes a top portion 51 and a bottom portion 53 disposed opposite of top portion 51. In some cases, bottom portion 53 may generally face towards, or confront, shoe 10, while top portion 51 may face outwardly from shoe 10. In addition, second component 30 may include a top portion 55 and a bottom portion 57 disposed opposite of the top portion 55. In some cases, bottom portion 57 is a portion or side of second component 30 configured to confront first component 20 when the two components are engaged.

In some embodiments, first fastener portion 21 may be disposed on top portion 51 of first component 20. In particular, in some cases, first fastener portion 21 may be disposed in the approximate center of top portion 51. In some cases, first fastener portion 21 may be disposed between openings 23 and openings 24. Second fastener portion 31 may be disposed on bottom portion 57 of second component 30. With this arrangement, first fastener portion 21 and second fastener portion 31 may engage one another when bottom portion 57 of second component 30 is placed against top portion 51 of first fastener portion 21, thereby fastening first component 20 and second component 30.

Figure 6:
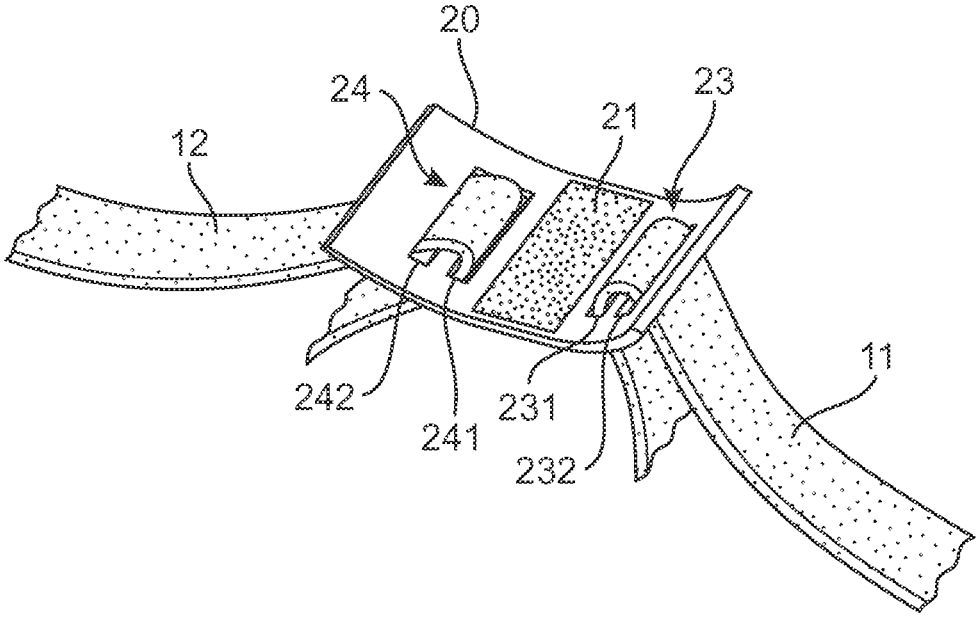
FIG. 6 is a perspective side top view of an embodiment of the first component, showing a first fastener portion of a hook-and-loop fastener on its top surface.
Figure 7:
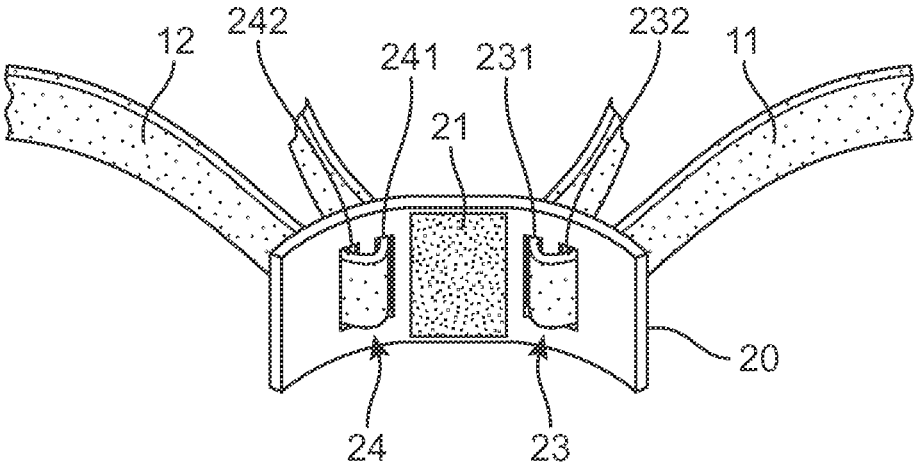
FIG. 7 is a front view of the embodiment shown in FIG. 6.
Figure 8:
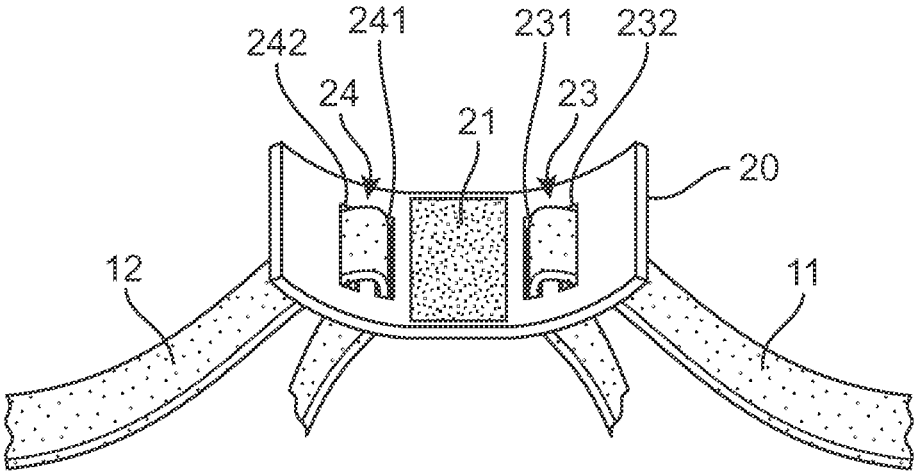
FIG. 8 is a top perspective view of the embodiment shown in FIG. 5.

In the example show in FIG. 2, and as also clearly seen in FIGS. 6-8, the use of two slots on either side of the first fastener portion 21 allows the first lace side 11 and second lace side 12 to be laced into first component 20 from underneath via, e.g., slot 231 and slot 241, respectively, then laced back down through slot 232 and slot 242, respectively. The lace sides can then be pulled forward from behind first component 20 and laced through second component 30, as described below. As clearly seen in FIGS. 6-8, in one possible arrangement, first lace side 11 and second lace side 12 of lace 15 are first laced through the slots closest to first fastener portion 21 (i.e., slot 231 and slot 241). However, in other embodiments, other configurations or arrangements of lace 15 through these slots may be possible.

Referring now to FIGS. 1-3 and 6-11, first lace side 11 and second lace side 12 of lace 15 are laced through first component 20 and second component 30 as follows. In this exemplary embodiment, first lace side 11 is laced through slot 231 and slot 232 of first component 20 and second lace side 12 is laced though slot 241 and slot 242 of first component 20 (see FIGS. 6-8). The two lace sides are then brought around from underneath first component 20 and laced into second component 30 via distal opening 34 (see FIGS. 9-11). From distal opening 34, first lace side 11 and second lace side 12 are then laced out through first intermediate opening 75, back into second component 30 through second intermediate opening 76. In some embodiments, first lace side 11 may be laced out of second component 30 via first side opening 35 and second lace side 12 may be laced out of second component 30 via second side opening 36. However, in another embodiment, first lace side 11 could be laced out via second side opening 36 and second lace side 12 could be laced out via first side opening 35.

Referring now to FIGS. 1 and 3-5, in use, lace 15 would be laced through shoe 10 and out of top eyelets 19 of shoe 10. From top eyelets 19, lace 15 would be laced through first component 20 and second component 30 of lace-tying system 18 by a parent, caregiver or other assistant. As previously discussed, first lace side 11 of lace 15 and second lace side 12 of lace 15 may be laced through first component 20 and second component 30, leaving first lace end 13 and second lace end 14 extending out from second component 30. In moving from the initial configuration of lace-tying system 18 shown in FIG. 1 to the configuration shown in FIG. 3, first component 20 may be pushed down or otherwise re-positioned towards top eyelets 19 of shoe 10. With this arrangement, after a foot is inserted into the shoe, first component 20 can be pushed down tightly against top eyelets 19 to close shoe 10 around the foot.

Figure 3:
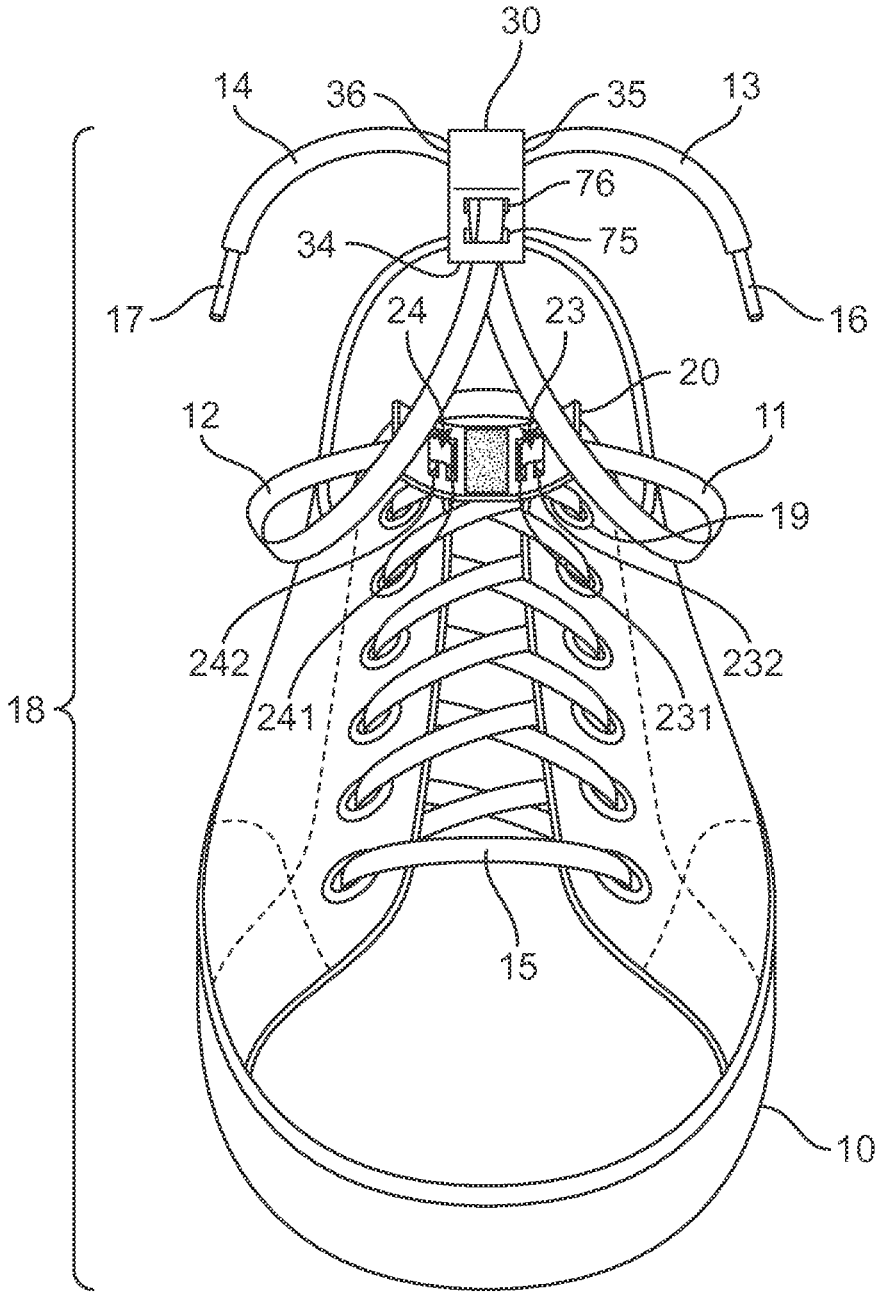
FIG. 3 is a front perspective view of an article of footwear with its lace laced through an embodiment of the lace-tying system, showing the lace-tying system folded partially over the top of the article of footwear.
Figure 4:
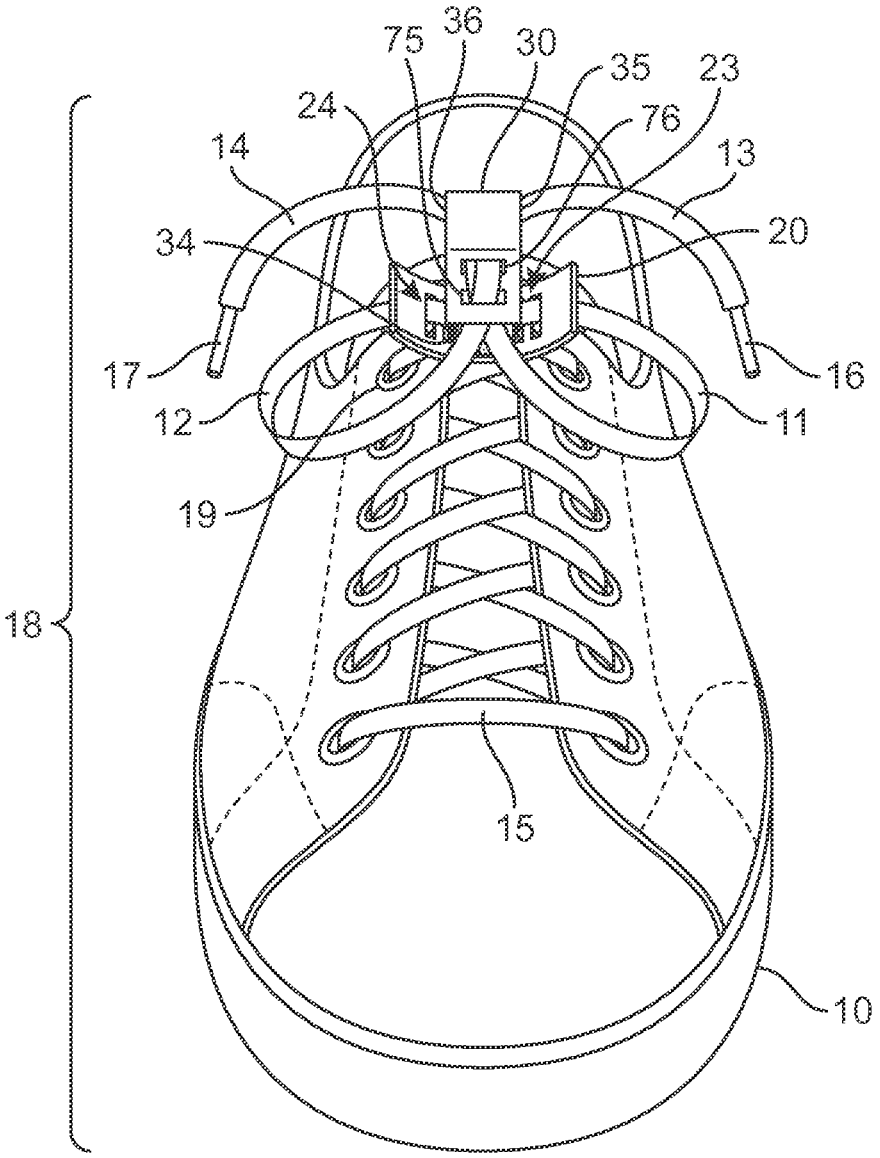
FIG. 4 is a front perspective view of an article of footwear with its lace laced through an embodiment of the lace-tying system, showing the lace-tying system just before the second component is attached to the first component.
Figure 5:
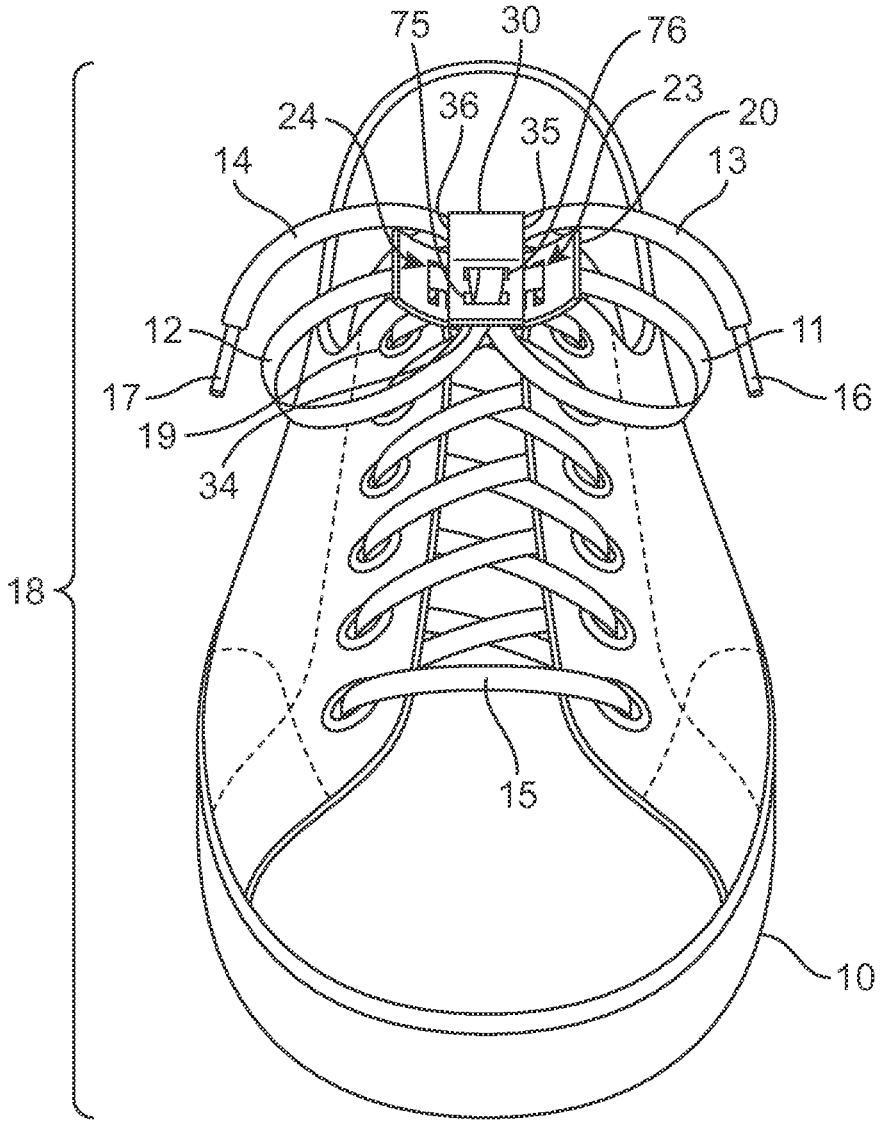
FIG. 5 is a front perspective view of an article of footwear with its lace laced through an embodiment of the lace-tying system, showing the lace-tying system with the second component attached to the first component.

FIGS. 3 through 5 illustrate a sequence of associating second component 30 with first component 20 according to an embodiment. Referring to FIGS. 3 through 5, once first component 20 has been pushed against shoe 10 in order to tighten lace 15, second component 30 may be placed in alignment with first component 20. As seen particularly in FIGS. 4 and 5, as second component 30 is lowered towards first component 20, first lace side 11 and second lace side 12 may start to arrange themselves in bow-like loops in the region of lace 15 between second component 30 and first component 20. These loops may be formed because of the excess lace material in first lace side 11 and second lace side 12 between first component 20 and second component 30. Once first component 20 and second component 30 have been fastened together, as seen in FIG. 5, lace-tying system 18 may sit comfortably and attractively on top of shoe 10, displaying bows formed from first lace side 11 and second lace side 12, respectively of lace 15. Further, first lace tip 16 and the second lace tip 17 may dangle conventionally on either side of shoe 10.

In some embodiments, lace 15 is a conventional shoe lace, having, for example, first conventional tip 16 and second conventional tip 17 at the ends of first lace side 11 and second lace side 12, respectively. However, in other embodiments, any other kind of lace could be used, including, but not limited to: strings, wires, cables, rounded laces, flattened laces, as well as any other kinds of laces known in the art for use with various types of footwear.

FIGS. 6, 7 and 8 are a perspective top view of an exemplary embodiment of first component 20, a front view of the embodiment of FIG. 6 and a top view of the embodiment of FIG. 6, respectively. These figures show a first side of a hook-and-loop fastener 21 on the top surface of first component 20, and the first lace side 11 of lace 15 and the second lace side 12 of lace 15 threaded through openings 23 (i.e., in these figures, slot 231 and slot 232) and openings 24 (i.e., in these figures, slot 241 and slot 242) in first component 20 from beneath. The use of openings 23 and openings 24 on first component 20 allows lace 15 to be laced in and out of first component 20 from underneath, such that when first component 20 is pushed down to the top of shoe 10, first component 20 will stay firmly in place. Additionally, in some cases, the lace sides could also be laced through loops attached to the back of the first component (not shown).

Because the lace sides shown in FIGS. 6-8 are laced from beneath first component 20 and then back down through component 20 to emerge on either side of component 20, component 20 generally takes on an arcuate shape in use, as shown in FIGS. 6-8. In the embodiments shown in the figures, second component 20 is rectangular, but any generally elongated (possibly, but not necessarily, symmetrical or somewhat symmetrical) shape could be used, with one side of a mechanical fastener in the center, and openings on either side.

Figure 9:
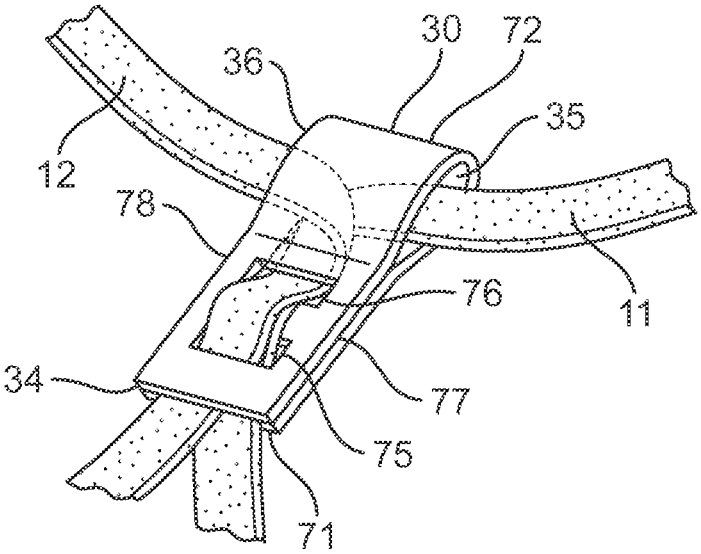
FIG. 9 is a perspective view of a first embodiment of the second component.
Figure 10:
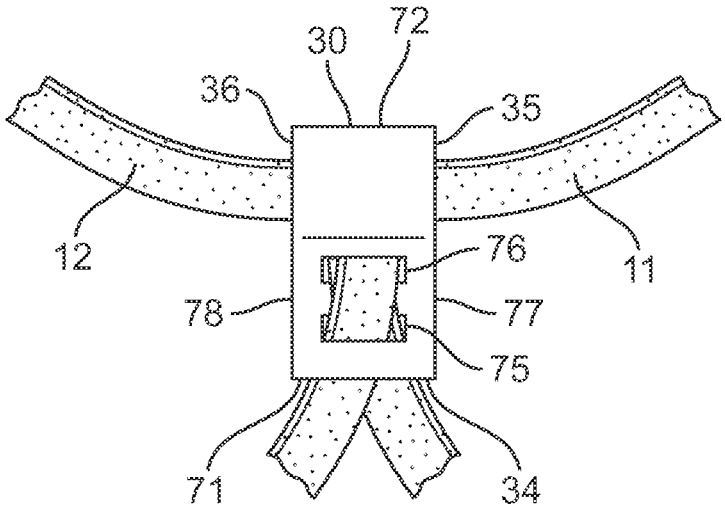
FIG. 10 is a top view of the embodiment shown in FIG. 9.
Figure 11:
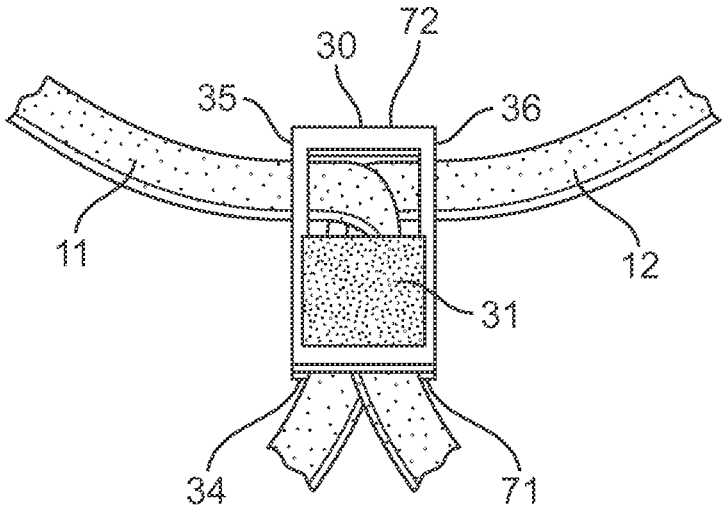
FIG. 11 is a bottom view of the embodiment shown in FIG. 9, showing a second fastener portion of a hook-and-loop fastener on its bottom surface.

FIG. 9 is a perspective view of a first exemplary embodiment of second component 30, showing first lace side 11 and second lace side 12, respectively, of lace 15 laced into a distal opening 34 at the distal end 71 of second component 30 and then out of first side opening 35 and second side opening 36 on either side of proximal end 72 of second component 30. FIGS. 10 and 11 are top and bottom views of the second component 30, respectively. In the exemplary embodiment of FIGS. 9-11, the second component 30 has a second fastener portion 31 of a hook-and-loop fastener on its bottom surface. The first fastener portion 21 and second fastener portion 31 of the hook-and-loop fastener attached to the first component 20 and second component 30, respectively, are complementary, i.e., the two components can be attached to each other by pressing the two sides of the hook-and-loop fasteners together.

Figure 12:
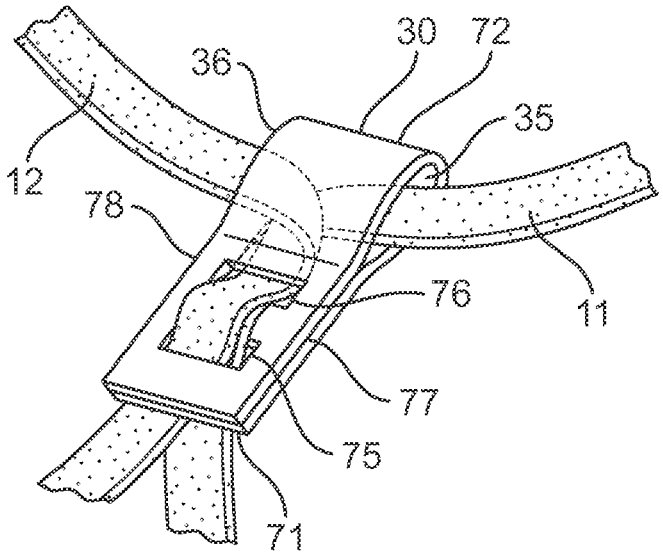
FIG. 12 is a perspective top view of a second embodiment of the second component.
Figure 13:
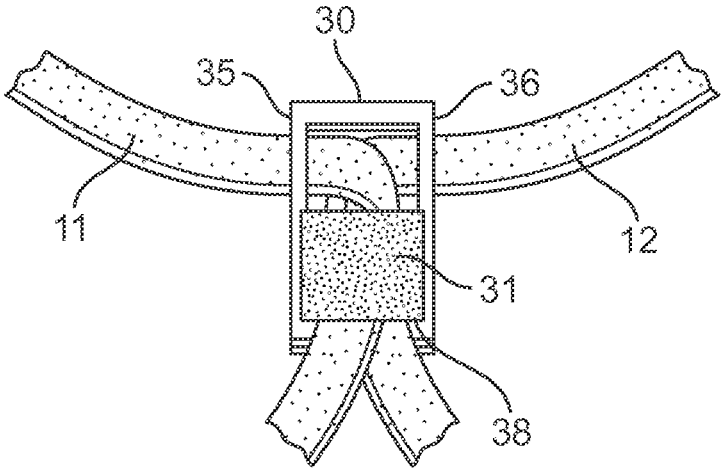
FIG. 13 is a bottom view of the embodiment shown in FIG. 12.
Figure 14:
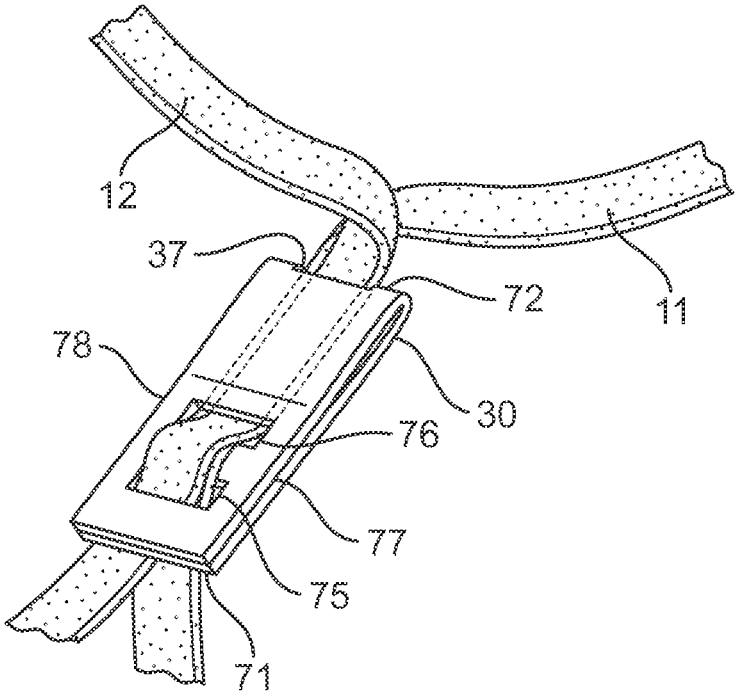
FIG. 14 is a perspective top view of another embodiment of the second component.

FIGS. 12 and 13 are a perspective top view and a bottom view, respectively, of a second exemplary embodiment of the second component. In this embodiment, lace side 11 and lace side 12 are inserted beneath one portion 31 of the mechanical faster, before being laced into second component 30 and then exiting via opening 35 and opening 36. Alternatively, the lace sides may be inserted between the mechanical faster portion 31 and the fabric or leather of the second component 30, and then pulled out on either side of second component 30, without actually entering the fabric or the leather part (not shown). In additional embodiments, for example, the second component could have an open side at its distal end 71, and openings on side 77 and side 78, towards or at the proximal end 72. Also, as in the embodiment shown in FIG. 14, second component 30 may have a single opening 37 at the proximal end 72, through which both first lace side 11 and second lace side 12 of lace 15 may pass. In an alternative version of this embodiment, second component 30 may have two openings at its proximal end 72 instead of a single opening. Other embodiments could also be implemented, based upon, for example, the specific footwear or other article the tying system may be intended for, ease-of-use, manufacturing, cost or other considerations.

The lace-tying system can be removed at any time, leaving behind a conventional shoe with conventional laces. The lace-tying system could then be used on other shoes. In certain embodiments, the lace-tying system may be washed or cleaned using appropriate cleaning fluids.

In different embodiments, the materials comprising components of a lace-tying system could vary. In some embodiments, component 20 and component 30 may be made of a relatively soft and flexible material such as leather or fabric. Such materials can be comfortable to wear, can be designed to have an attractive appearance, and are soft to the touch as the wearer pushes the first component down to tighten the lace-tying system or pushes it up to loosen the lace-tying system. However, in other embodiments, any other materials could be used for components of a lace-tying system including, but not limited to: polymer materials, woven materials, non-woven materials, metallic and/or metal alloy materials as well as possibly other materials. The types of materials used can be selected according to various factors including, for example, manufacturing costs, comfort, durability, appearance as well as possibly other factors.

While various embodiments have been described above, the description is intended to be exemplary, rather than limiting. It will be apparent to those of ordinary skill in the art that additional embodiments and implementations are possible. Accordingly, the embodiments are not to be restricted except in light of the attached claims and their equivalents.

What is claimed is:

1. A lace-tying system for an article, the lace-tying system comprising:

a lace member having a first end defining a first terminus of the lace member, a second end defining a second terminus of the lace member, and a lace body extending between the first end and the second end;

a first component disposed along a length of the lace body between the first end and the second end and including a first surface opposing the article, a second surface formed on an opposite side of the first component than the first surface, a first pair of openings extending through a thickness of the first component between the first surface and the second surface, and a second pair of openings spaced apart from the first pair of openings and extending through a thickness of the first component between the first surface and the second surface, the first pair of openings receiving the first end of the lace member and the second pair of openings receiving the second end of the lace member; and a second component selectively attached to the first component and receiving the first end of the lace member and the second end of the lace member such that a first span of the lace body extends between the first component and the second component and a second span of the lace body extends between the first component and the second component, the second component being disposed between the first end of lace member and the first component and between the second end of the lace member and the first component.

2. The lace-tying system of claim 1, wherein the first span is spaced apart and separated from the first component and the second component.

3. The lace-tying system of claim 2, wherein the second span is spaced apart and separated from the first component and the second component.

4. The lace-tying system of claim 1, wherein a first loop is formed by the first span when the second component is attached to the first component and a second loop is formed by the second span when the second component is attached to the first component.

5. The lace-tying system of claim 1, wherein the second component is selectively attached to the first component via a fastener.

6. The lace-tying system of claim 5, wherein the fastener is one of a hook-and-loop fastener and a snap fastener and includes a first portion attached to the first component and a second portion attached to the second component.

7. The lace-tying system of claim 6, wherein the first portion of the fastener is disposed between the first pair of openings the second pair of openings.

8. The lace-tying system of claim 7, wherein the first component is elongate, the first portion of the fastener being disposed between the first pair of openings and the second pair of openings in a direction along a longitudinal axis of the first component.

9. The lace-tying system of claim 1, wherein the first surface of the first component includes a convex shape and the second surface of the first component includes a concave shape.

10. The lace-tying system of claim 1, wherein the first end of the lace member passes through one of the first pair of openings in a direction extending from the first surface to the second surface and passes through the other of the first pair of openings downstream from the one of the first pair of openings in a direction extending from the second surface to the first surface and the second end of the lace member passes through one of the second pair of openings in a direction extending from the first surface to the second surface and passes through the other of the second pair of openings downstream from the one of the second pair of openings in a direction extending from the second surface to the first surface.

11. A lace-tying system for an article, the lace-tying system comprising:

a lace member having a first end, a second end, and a lace body extending between the first end and the second end;

a first component disposed along a length of the lace body between the first end and the second end and including a first surface opposing the article, a second surface formed on an opposite side of the first component than the first surface, a first opening extending through a thickness of the first component between the first surface and the second surface, a second opening spaced apart from the first opening and extending through a thickness of the first component between the first surface and the second surface, and a first fastener attached to the second surface of the first component and disposed between the first opening and the second opening, the first opening receiving the first end of the lace member and the second opening receiving the second end of the lace member; and a second component selectively attached to the first component via the first fastener and receiving the first end of the lace member and the second end of the lace member such that a first span of the lace body extends between the first component and the second component and a second span of the lace body extends between the first component and the second component, the second component being disposed closer to the first end of lace member and the second end of the lace member than the first component, the first end of the lace member extending from the second component in a first direction and the second end of the lace member extending from the second component in a second direction opposite the first direction when the second component is attached to the first component.

12. The lace-tying system of claim 11, wherein the first span is spaced apart and separated from the first component and the second component.

13. The lace-tying system of claim 12, wherein the second span is spaced apart and separated from the first component and the second component.

14. The lace-tying system of claim 11, wherein a first loop is formed by the first span when the second component is attached to the first component and a second loop is formed by the second span when the second component is attached to the first component.

15. The lace-tying system of claim 11, wherein the second component includes a second fastener that is attached to an outer surface of the second component and is selectively attached to the first fastener.

16. The lace-tying system of claim 15, wherein the first fastener and the second fastener are one of a hook-and-loop fastener and a snap fastener.

17. The lace-tying system of claim 11, wherein the first component includes a third opening disposed adjacent to the first opening and receiving the first end of the lace member and a fourth opening disposed adjacent to the second opening and receiving the second end of the lace member, the first opening and the third opening being disposed on opposite sides of the first fastener than the second opening and the fourth opening.

18. The lace-tying system of claim 17, wherein the first component is elongate, the first opening and the third opening being disposed on opposite sides of the first fastener than the second opening and the fourth opening in a direction along a longitudinal axis of the first component.

19. The lace-tying system of claim 17, wherein the first end of the lace member passes through the first opening in a direction extending from the first surface to the second surface and passes through the third opening downstream from the first opening in a direction extending from the second surface to the first surface and the second end of the lace member passes through the second opening in a direction extending from the first surface to the second surface and passes through the fourth opening downstream from the second opening in a direction extending from the second surface to the first surface.

20. The lace-tying system of claim 11, wherein the first surface of the first component includes a convex shape and the second surface of the first component includes a concave shape.

* * * * *